US010989375B2

(12) United States Patent
Santos et al.

(10) Patent No.: US 10,989,375 B2
(45) **Date of Patent: *Apr. 27, 2021**

(54) LED LIGHT FIXTURE FOR INDIRECT LIGHTING WITH ADAPTABLE BAFFLE STRUCTURE

(71) Applicant: FINELITE INC., Union City, CA (US)

(72) Inventors: Arlan R. Santos, Milpitas, CA (US); David Daoud Aziz, Pleasanton, CA (US); Johannes Dale Toale, San Jose, CA (US); My Tien Nguyen, Redwood City, CA (US); Aaron Matthew Smith, Fremont, CA (US); Kyle Tomas Martin, Fremont, CA (US); Timothy Shepard, Alameda, CA (US); Wenhui Zhang, Shanghai (CN)

(73) Assignee: Finelite Inc., Union City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/873,526

(22) Filed: Apr. 27, 2020

(65) Prior Publication Data

US 2020/0263843 A1 Aug. 20, 2020

Related U.S. Application Data

(63) Continuation of application No. 16/501,832, filed on Jun. 13, 2019, now Pat. No. 10,718,476, which is a (Continued)

(51) Int. Cl.
*F21S 4/20* (2016.01)
*F21V 5/04* (2006.01)

(Continued)

(52) U.S. Cl.
CPC ..... *F21S 4/20* (2016.01); *F21V 3/00* (2013.01); *F21V 5/04* (2013.01); *F21V 7/005* (2013.01);

(Continued)

(58) Field of Classification Search
CPC ..... F21S 4/20; F21S 6/008; F21V 7/0008; F21V 7/0016–005; F21K 9/62; F21K 9/68

See application file for complete search history.

(56) References Cited

U.S. PATENT DOCUMENTS 8,436,375 B2 * 5/2013 Miura ..... F21V 17/005 257/91
9,285,084 B2 * 3/2016 Amrine, Jr. ..... F21V 17/04

(Continued)

*Primary Examiner* — Mariceli Santiago
(74) *Attorney, Agent, or Firm* — James A. Gavney, Jr.; JAG Patent Services

(57) ABSTRACT

An LED light fixture is disclosed with an elongated housing that forms a open lower light channel and an upper light channel that is juxtaposed to the open lower light channel with electronics cavity or conduit positioned there between. The LED light fixture preferably has an elongated reflective insert that extends through the open lower light channel and creates a reflection channel from which the indirect and reflected light is emitted and a detachable cover structure that includes a diffusion lens and a removable baffle structure that attaches to side walls of the upper light channel.

11 Claims, 12 Drawing Sheets

Related U.S. Application Data continuation-in-part of application No. 16/501,180, filed on Mar. 1, 2019, now Pat. No. 10,670,205.

(60) Provisional application No. 62/761,131, filed on Mar. 9, 2018.

(51) Int. Cl.

| | |
|---|---|
| ***F21V 7/04*** | (2006.01) |
| ***F21V 7/00*** | (2006.01) |
| ***F21V 3/00*** | (2015.01) |
| ***F21V 15/01*** | (2006.01) |

(52) U.S. Cl.

CPC ..... *F21V 7/0008* (2013.01); *F21V 7/0025* (2013.01); *F21V 7/04* (2013.01); *F21V 15/01* (2013.01)

(56) References Cited

U.S. PATENT DOCUMENTS

| | | | | |
|---|---|---|---|---|
| 10,718,476 | B2 * | 7/2020 | Santos | F21V 3/00 |
| 2005/0207166 | A1 * | 9/2005 | Kan | F21V 29/89 362/373 |
| 2011/0058377 | A1 * | 3/2011 | Chou | F21S 4/28 362/294 |
| 2015/0241023 | A1 * | 8/2015 | Kim | F21V 7/0041 362/296.05 |
| 2015/0345743 | A1 * | 12/2015 | Trincia | F21V 5/048 362/223 |
| 2016/0305631 | A1 * | 10/2016 | Hansen | H05B 45/00 |
| 2018/0163946 | A1 * | 6/2018 | Santoro | F21V 7/0016 |
| 2019/0277463 | A1 * | 9/2019 | Santos | F21V 7/005 |

* cited by examiner

LED LIGHT FIXTURE FOR INDIRECT LIGHTING WITH ADAPTABLE BAFFLE STRUCTURE

RELATED APPLICATION

This application is a continuation application of the U.S. patent application Ser. No. 16/501,832, filed Jun. 13, 2019 and titled "LED LIGHT FIXTURE FOR INDIRECT LIGHTING WITH ADAPTABLE BAFFLE STRUCTURE" which is continuation-in-part of the co-pending U.S. patent application Ser. No. 16/501,180 filed Mar. 1, 2019, and titled "OPEN CHANNEL LED LIGHT FIXTURE FOR INDIRECT LIGHTING," which claims priority under 35 U.S.C. § 119(e) from the U.S. provisional patent application Ser. No. 62/761,131, filed on Mar. 9, 2018, and titled "LIGHTING SYSTEM WITH LED ARRAYS."

The co-pending U.S. patent application Ser. No. 16/501,832, filed Jun. 13, 2019 and titled "LED LIGHT FIXTURE FOR INDIRECT LIGHTING WITH ADAPTABLE BAFFLE STRUCTURE", the U.S. patent application Ser. No. 16/501,180 filed Mar. 1, 2019, and titled "OPEN CHANNEL LED LIGHT FIXTURE FOR INDIRECT LIGHTING" and the U.S. provisional patent application Ser. No. 62/761,131, filed on Mar. 9, 2018, and titled "LIGHTING SYSTEM WITH LED ARRAYS" are all hereby incorporated by reference.

FIELD OF THE INVENTION

This invention relates to lighting systems. More specifically, this invention relates to Light Emitting Diode (LED) devices and systems.

BACKGROUND OF THE INVENTION

A light-emitting diode (LED) is a semiconductor diode that emits light when an electrical current is applied in the forward direction of the device, such as in a simple LED circuit.

The device is fabricated from layers of silicon and seeded with atoms of phosphorus, germanium, arsenic or other rare-earth elements. The layers of the device are called the die and the junction between the materials is where the light is generated. The electricity enters from one side of the die and exits out the other. As the current passes through the LED device, the materials that makes up the junction react and light is emitted.

LEDs are widely used as indicator lights on electronic devices and increasingly in higher power applications such as flashlights and area lighting. A LED is usually a small area (less than 1 $mm^2$) light source, often with optics added to the chip to shape its radiation pattern and assist in reflection. The color of the emitted light depends on the composition and condition of the semiconducting material used, and can be infrared, visible, or ultraviolet. The glow, color and wash of a lighting fixture with sets of LED arrays is sensitive to the angles of the LED arrays with respect to one and other.

SUMMARY OF THE INVENTION

An LED light fixture of the present invention includes an elongated housing. Within the elongated housing, there is at least one extended or elongated open light cavity, hereafter lower light channel. The lower light channel has elongated inner side walls, elongated inner top walls and an elongated open bottom, hereafter referred to lower light channel side walls, top walls and open bottom. The lower light channel is contoured to have any number of shapes including, but not limited to, rectangular, triangular, angled, curved, rounded shapes or a combination thereof. In accordance with an embodiment of the invention, the elongated housing is formed from an extruded, molded or otherwise formed metal or plastic material. Preferably, the lower light channel is formed from a contoured reflective metal or plastic reflective insert that fits within a lower portion of the elongated housing.

Near or at bottom portions of the side walls, and near the open bottom of the lower light channel, there are support edges that extend along the lower light channel and/or elongated housing. Positioned on top surfaces of the support edges, there are elongated light engines. The elongated light engines include LED arrays or LED strips that have light emitting surfaces facing upward for emitting light into the lower light channel.

In operation and with the LED arrays or LED strips energized, the LED arrays or LED strips emit light into the lower light channel and the light is reflected off wall surfaces and top surfaces of the lower light channel to emit indirect light out through the open bottom of the lower light channel.

In accordance with further embodiments of the present invention, an elongated LED light fixture provides upward and downward lighting. In accordance with this embodiment, the elongated LED light fixture has an upper light channel that is substantially similar to the lower light channel, such as described above, wherein an elongated housing of the light fixture has an H-shaped cross-section with an elongated electronics cavity or conduit positioned between the upper light channel and the lower light channel. The elongated electronics cavity or conduit is used for housing wiring, LED drivers and other control circuitry.

In accordance with further embodiments of the invention, the upper light channel has LED arrays or LED strips positioned on a top surface within the upper light channel. For example, the LED arrays or LED strips are centrally positioned on a top surface and within the upper light channel. The LED arrays, or LED strips position contained therein or on the top surface, can be angled and/or have symmetric or asymmetric diffusion lenses positioned over light emitting surfaces of the LED arrays or LED strips. It will be clear to one skilled in art that LED arrays and/or LED strips used in the light fixture of the present invention can be physically or optically configured to throw indirect and/or direct light having any number of preferred lighting patterns. Additional details of LED light fixtures with angled LED arrays and asymmetric lenses are provided in U.S. Pat. No. 10,024,522 B2, titled "LIGHT SYSTEM WITH ANGLED LED ARRAYS," the contents of which are hereby incorporated by reference.

In a preferred embodiment of the invention the LED light fixture includes a detachable cover structure with an H-shaped support feature. The H-shaped support feature has arms that are bridged by a diffusion lens. The detachable cover structure further includes a removable baffle. In operation, the arms of the H-shaped support feature have sets of snap features that attach to side walls of the upper light channel and matched groove features on the removable baffle.

A LED light system of the present invention utilizing the LED light fixtures described above can be equipped with advanced control systems and/or control interfaces that allows for dimming and color temperature tuning. Control commands, operational protocols, or communication networks in the LED lighting system utilize and number of standards, including Digital Signal Interface (DSI) 0-10 V lighting control signals and formats, Digital Addressable Lighting Interface (DALI) lighting control signals and formats, DMX512 (Digital Multiplex) control signals and formats, or a combination thereof.

The LED lighting system, for example, includes a control unit coupled to one or more LED light fixtures for controlling power to the LED light fixtures based on control command signals provided by any number of sensors, switches and control interface devices interface devices. A control unit includes, for example, a wireless transmitter for receiving and processing input control signals from a remote control interface device, such as a smart-phone or computer.

The LED arrays or LED strips (LED light engines) used in the lighting fixtures of the present invention can have any number of LEDs and can include LEDs that emit any color or combinations of colors and can be tunable to change color through the advanced control systems. Also, the light engines used in the light fixtures of the present invention can be mounted on modular light boards that are independently serviceable.

Advanced control systems, control interfaces and modular LED light boards are further described in U.S. Pat. No. 9,964,265 B2, titled "LIGHT EMITTING DIODE LUMINAIRE DEVICE AND SYSTEM WITH COLOR TEMPERATURE TUNING," the contents of which are hereby incorporated by reference.

DETAILED DESCRIPTION OF THE INVENTION

Figure 1A:
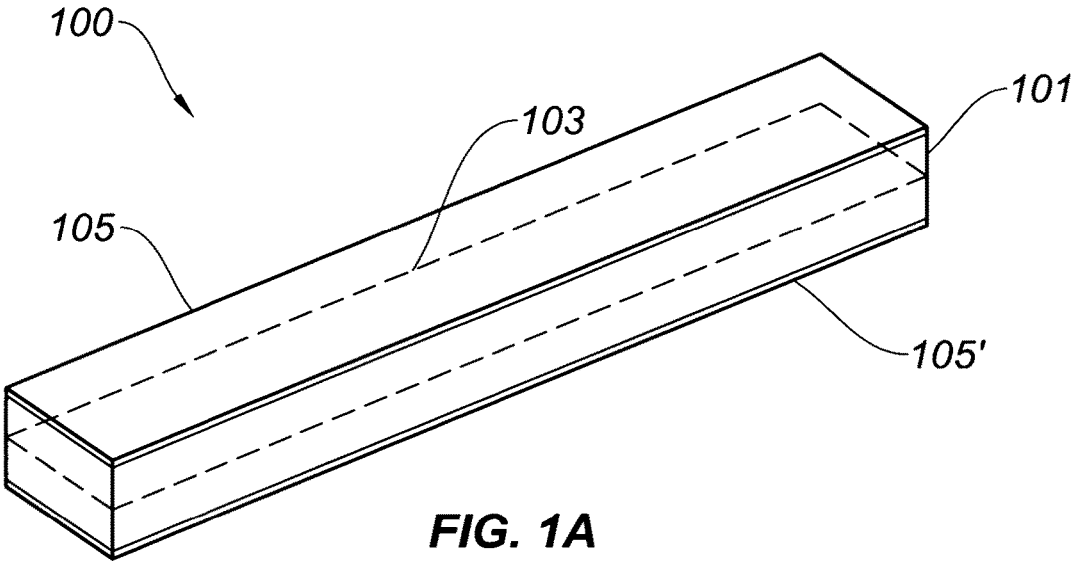
FIG. 1A shows a schematic representation an elongated LED light fixture with an elongated LED light board and LEDs positioned on top and bottom, or opposed sides, of the elongated LED light board to provide upward and downward lighting.
Figure 1B:
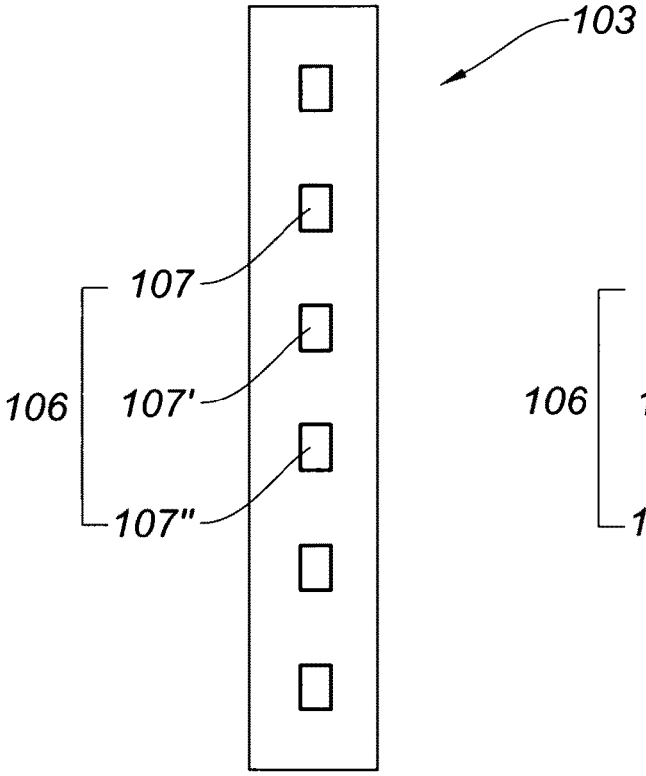
FIG. 1B-C show schematic representations of the elongated LED light board used in the light fixture shown in FIG. 1A.
Figure 1C:
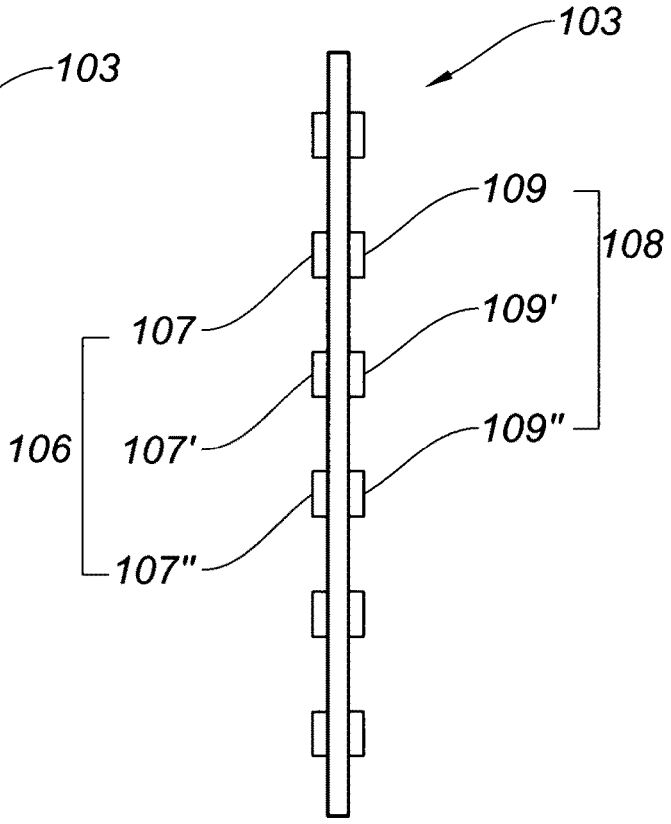

Referring to FIGS. 1A-C, an elongated LED light fixture 100 has an elongated LED light board 103. The elongated LED light board 103 is housed within elongated housing 101. The elongated light fixture includes a bottom diffusion lens 105 and a top diffusion lens.

The elongated light board include arrays of LEDs 106 and 108 (upper array of LEDs and lower arrays of LEDs) on opposed sides of the elongated LED light board as shown. The individual LEDs 107, 107' and 107" and 109, 109' and 109" within the arrays of LEDs 106 and 108 can be the same or different.

Figure 1D:
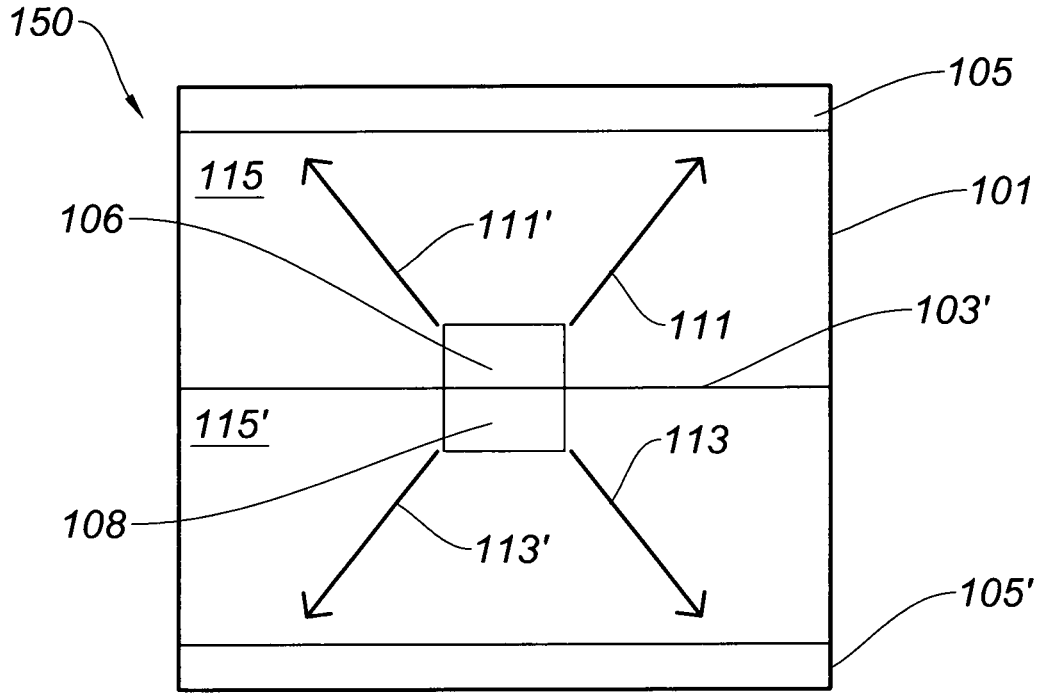
FIG. 1D shows a cross-sectional view of the elongated LED light fixture shown in FIG. 1A.

FIG. 1D shows a cross-sectional view 150 of the elongated LED light fixture 100 shown in FIG. 1A. The elongated LED light fixture 150 has an upper light channel 115 and a lower light channel 115'. The upper light channel 115 and a lower light channel 115' are formed by the housing 101. In operation, light that is emitted from the upper array of LEDs 106 and the lower array of LEDs 108 on the light board 103', as indicated by the arrows 111/111' and 113/113', pass through the upper diffusion lens 105 and lower diffusion lens 105' to provide upward and downward lighting, respectfully.

Figure 2:
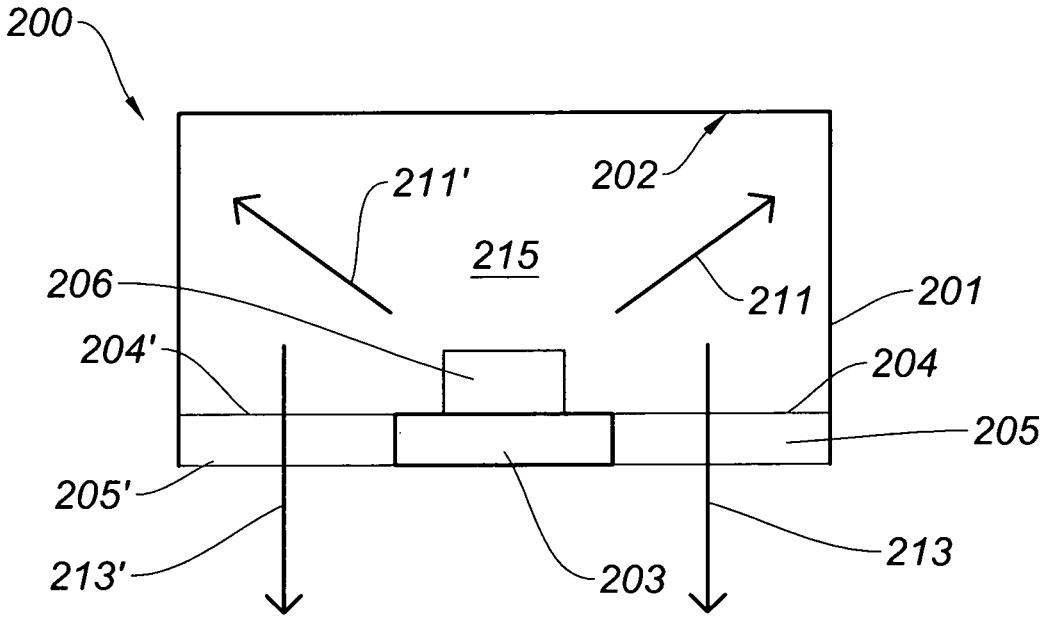
FIG. 2 shows a cross-sectional view of an LED light fixture that provides indirect light from internal reflection of light emitted from a top surface of a centrally located LED light board within a light channel.

FIG. 2 shows a cross-sectional view 200 of an LED light fixture that provides what is herein referred to "indirect light" by internal reflection of light emitted from a top surface of a centrally located LED light board 203 positioned within the a light channel 215 of the LED light fixture. In operation, an LED array 206 mounted on the light board 203 emits light, indicated by the arrows 211 and 211', into the light channel 215 formed by a housing 201. The emitted light 211 and 211' is reflected off of inner surfaces 202 of the light channel 215 and is emitted through bottom portions 204 and 204' of the light fixture. The bottom portions 204 and 204' of the light fixture can be covered with diffusion lenses 205 and 205'.

Figure 3A:
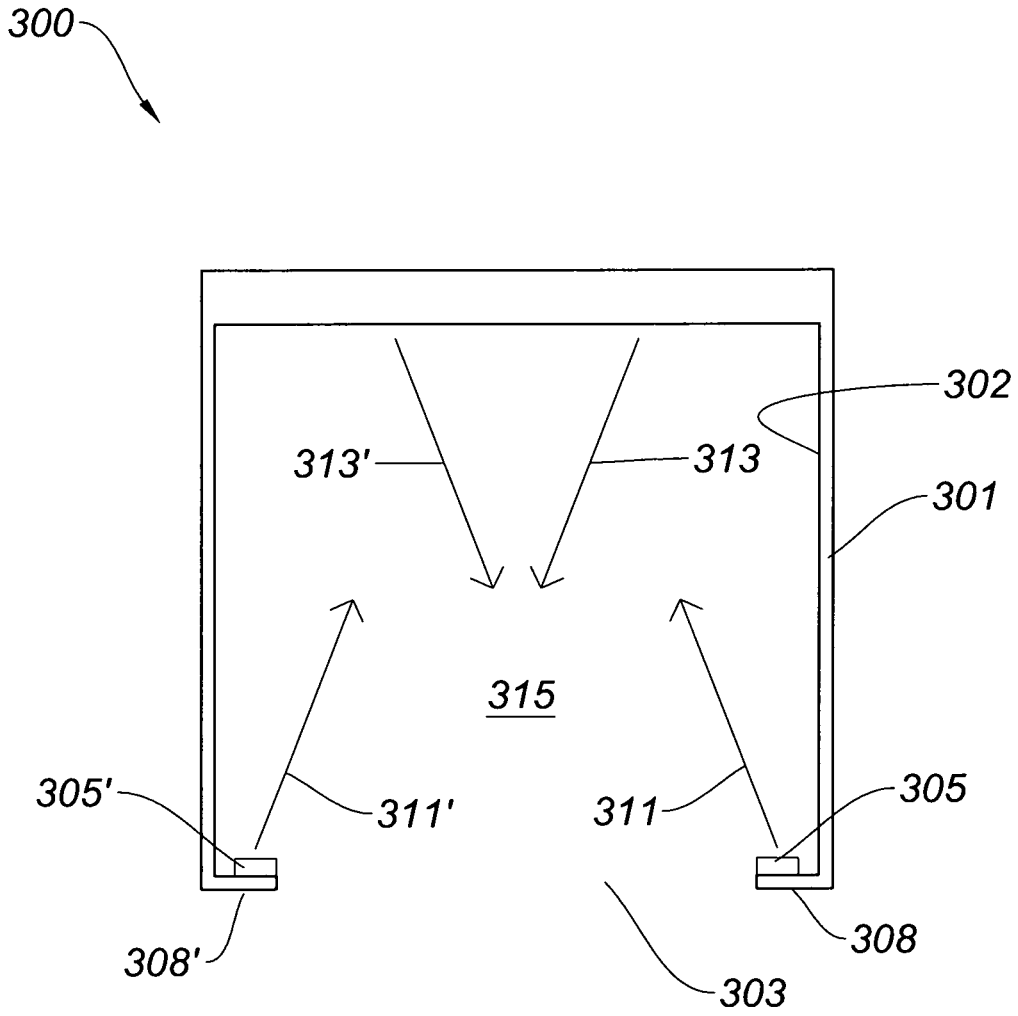
FIGS. 3A-C illustrate cross-sectional views of LED light fixtures with light engines mounted along side walls of an elongated light channel, in accordance with the embodiments of the invention.

FIG. 3A illustrates cross-sectional view 300 of an LED light fixture, in accordance with the embodiments of the invention. The an LED light fixture has a rectangular elongated housing 301. Within the rectangular elongated housing 301 there is at least one extended or elongated open light cavity 315, hereafter lower light channel, open lower light channel or open lower light cavity. The lower light channel 315 has elongated inner side walls, and elongated inner top walls, represented by 302, hereafter referred to inner surfaces and an open bottom 303. The lower light channel 315 is contoured to have any number of shapes and is preferably formed from an extruded, molded or otherwise formed metal or plastic material. The inner walls 302 of the lower light channel 315 are preferably reflective.

Near or at bottom portions of the inner walls 302 of the housing 301, and near the open bottom 303 of the lower light channel 315 there are opposed support edges of structure 308 and 308' that extend along the bottom portions of the inner walls 302 of the lower light channel 315 and/or elongated housing 301. The support edges 308 and 308' can have L-shaped cross-sections, be segmented, or continuous along the lower light channel 315 and/or elongated housing 301 and/or be symmetric or asymmetric in width or height.

Positioned on inner top surfaces of the support edges 308 and 308' there are elongated LED light engines 305 and 305' that have light emitting surfaces facing upward for emitting light into the lower light channel 315, as indicated by the arrows 311 and 311'. The light emitted 311 and 311' emitted from the elongated LED light engines 305 and 305' is reflected off the inner surfaces 302 of the elongated light channel 315, as indicated by the arrows 313 and 313', and is emitted through the open bottom 303 of the lower light channel 315.

Figure 3B:
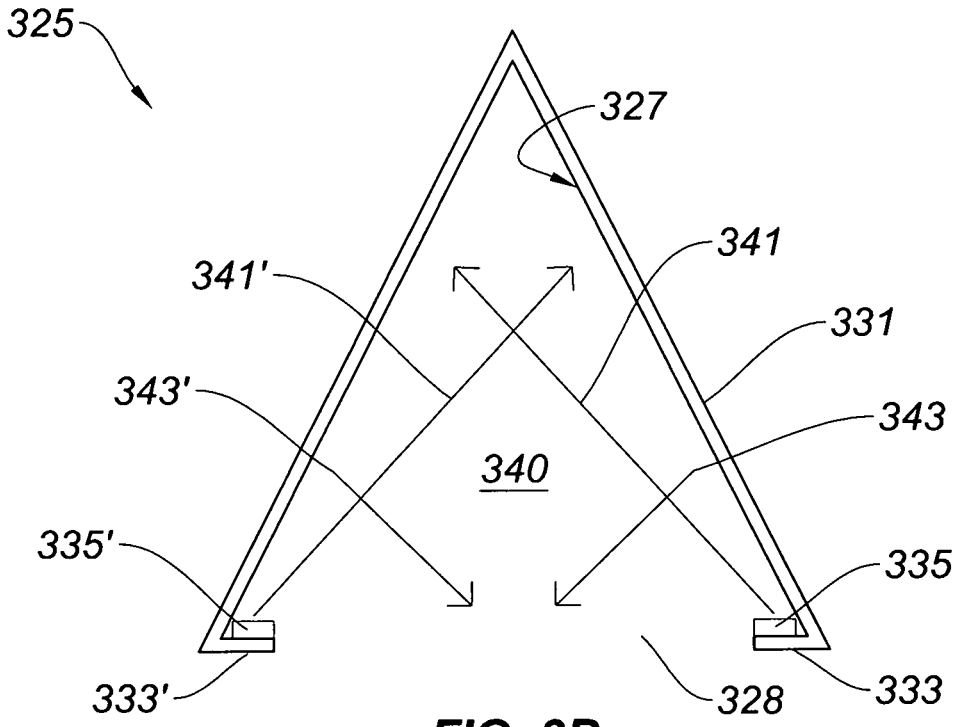

FIG. 3B illustrates cross-sectional view 325 of an LED light fixture, in accordance with the embodiments of the invention. The LED light fixture has a triangular elongated housing 331 that forms a lower light channel 340 with inner walls 327 and an open bottom 328.

Near or at bottom inner wall portions 325 and near the open bottom 328 of the lower light channel 340, there are support edges 333 and 333' that extend along the bottom inner wall portions 327 of the lower light channel 340 and/or elongated housing 331.

Positioned on inner top surfaces of the support edges 333 and 333' there are elongated LED light engines 335 and 335' that have light emitting surfaces facing upward for emitting light into the lower light channel 340, as indicated by the arrows 341 and 341'. The light emitted 341 and 341' emitted from the elongated LED light engines 335 and 335' is reflected off the inner surfaces 327 of the elongated light channel 340, as indicated by the arrows 343 and 343', and is emitted through the open bottom 328 of the lower light channel 340.

Figure 3C:
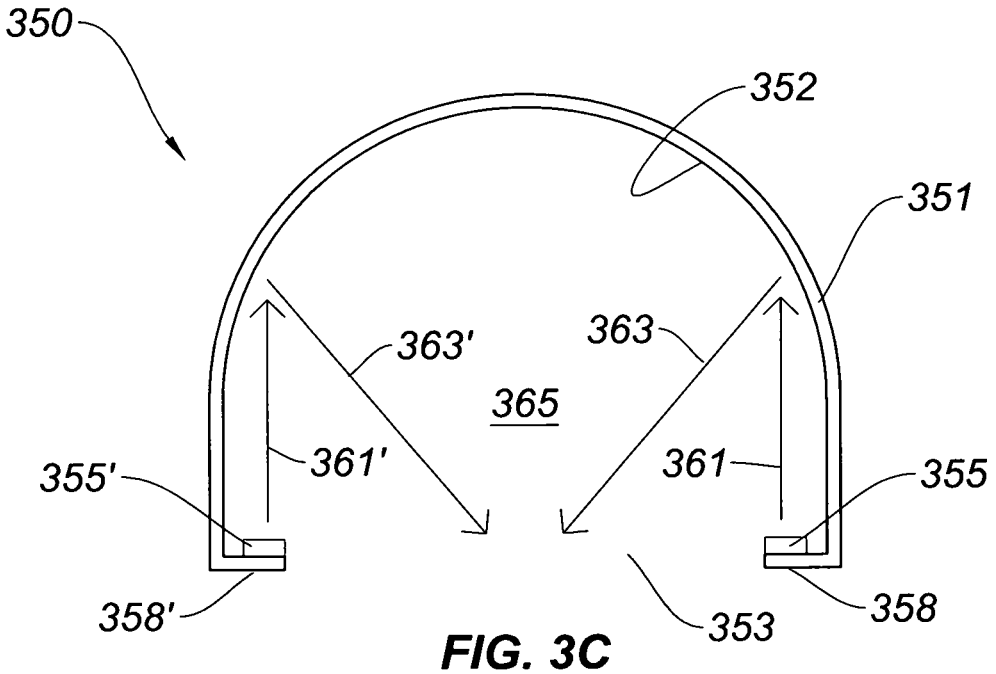

FIG. 3C illustrates cross-sectional view 350 of an LED light fixture, in accordance with the embodiments of the invention. The an LED light fixture has a rounded elongated housing 351 that forms a lower light channel 365 with inner walls 352 and open bottom 353.

Near or at bottom inner wall portions 352 and near the open bottom 353 of the lower light channel 365 there are support edges 358 and 358' that extend along the bottom inner wall portions 352 of the lower light channel 365 and/or elongated housing 351.

Positioned on inner top surfaces of the support edges 358 and 358' there are elongated LED light engines 355 and 355' that have light emitting surfaces facing upward for emitting light into the lower light channel 365, as indicated by the arrows 361 and 361'. The light emitted 361 and 361' emitted from the elongated LED light engines 355 and 355' is reflected off the inner surfaces 352 of the elongated light channel 365, as indicated by the arrows 363 and 363', and is emitted through the open bottom 353 of the lower light channel 365.

Figure 4A:
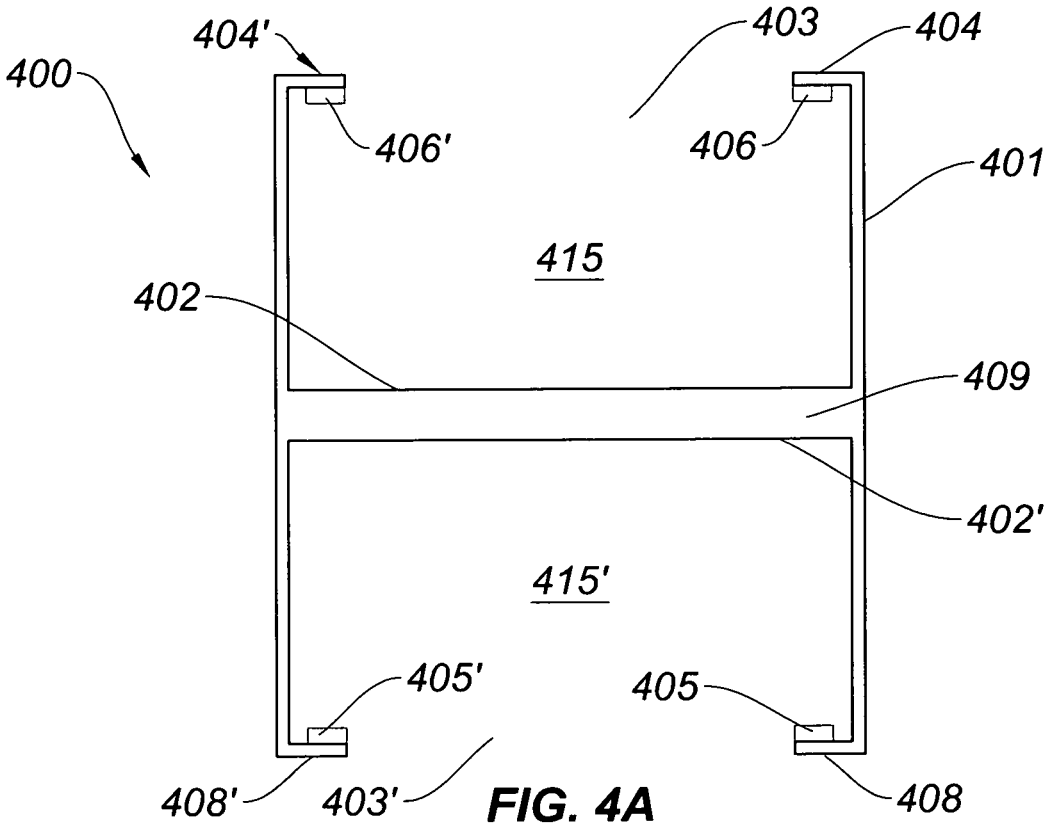
FIG. 4A shows a cross-sectional view of an LED light fixture with an upper light channel and a lower light channel, each having light engines mounted along side walls, in accordance with the embodiments of the invention.

FIG. 4A illustrates cross-sectional view 400 of an LED light fixture, in accordance with further embodiments of the invention. The LED light fixture has a elongated housing 401 with an H-shaped cross-section that forms an upper light channel 415 with an open top 403 and a lower light channel 415' with an open bottom that are juxtaposed with respect to each other. While the upper light channel 415 and a lower light channel 415' are shown to be rectangular, it will be clear for the previous examples that other shapes including, but not limited to, triangular, angled, curved, rounded shapes or combinations thereof are envisioned. Each of the upper light channel 415 and a lower light channel 415' have reflective inner surfaces 402 and 402' for reflecting light emitted therein. Between the inner walls 402' and 402 of the upper light channel 415 and the lower light channel 415', there is an elongated electronics cavity or conduit 409 positioned for housing wiring, LED drivers and/or other control circuitry.

Near or at top portions of the inner walls 402 of the housing 401, as well as the open top 403 of the upper light channel 415, and at or near bottom portions of the inner walls 402', as well as the open bottom 403', there are support edges 404/404' and 408/408', respectively, that extend along portions of the inner walls 402 and 402' of the upper light channel 415 and the lower light channel 415', respectively.

Positioned on inner top surfaces of the support edges 404/404' and 408/408' there are elongated LED light engines 406/406' and 405/405' having light emitting surfaces facing inward for emitting light into the upper light channel 415 and lower light channel 415'. The light emitted from the elongated LED light engines 406/406' and 405/405' is reflected off the inner surfaces 402 and 402' of the upper light channel 415 and lower light channel 415', respectively, and is emitted through the open bottom open top 403 and open bottom 403'.

Figure 4B:
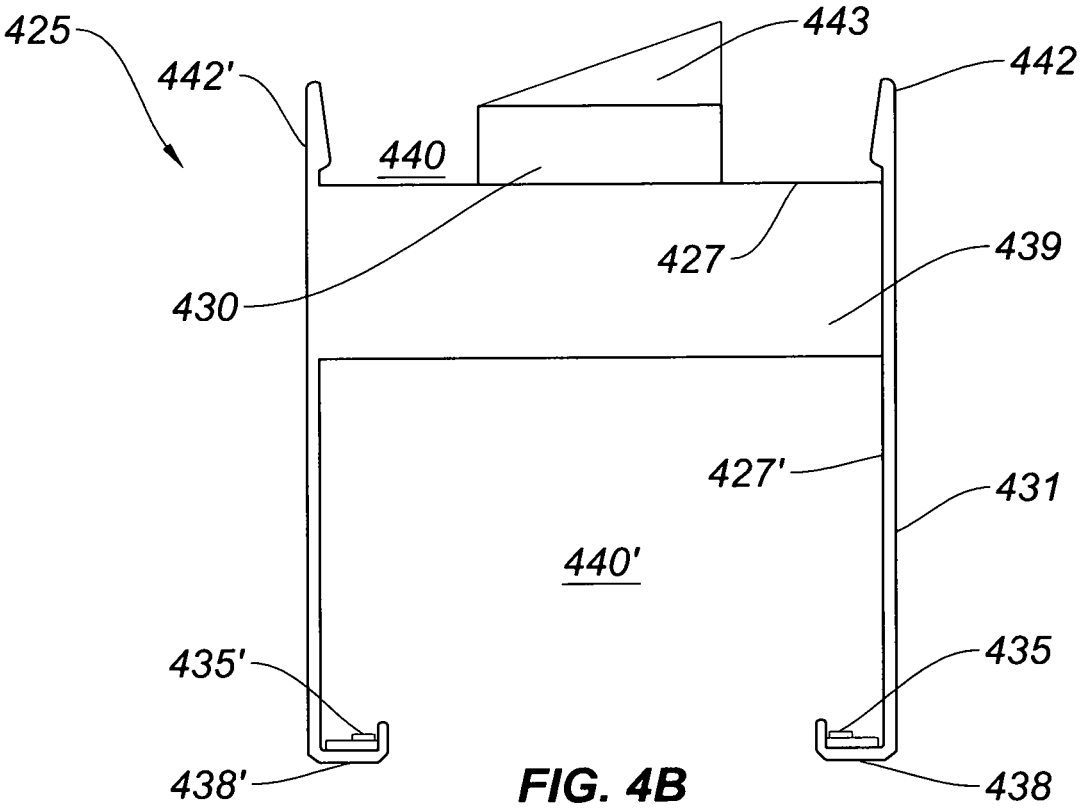
FIG. 4B shows a cross-sectional view of an LED light fixtures with an upper light channel and a lower light channel, wherein the lower light channel has light engines mounted along side walls of the lower light channel and centrally mounted light engine mounted on a top surface within the upper light channel.

FIG. 4B illustrates cross-sectional view 425 of an LED light fixture, in accordance with yet further embodiments of the invention. The LED light fixture has an elongated housing 431 with a truncated H-shaped cross-section that forms an upper light channel 440 with an open top and a lower light channel 440' with an open bottom, wherein the upper light channel and the lower light channel are juxtaposed with respect to each other. Between the upper light channel 440 and the lower light channel 440' there is an elongated electronics cavity or conduit 439 for housing wiring, LED drivers and/or other control circuitry.

Near or at bottom portions of the inner walls 427' of the housing 431, and near the open bottom of the lower light channel 440' there are support edges 438 and 438' that extend along portions of the inner walls 427' of the lower light channel 440'. In this example, the support edges 438 and 438' are J-shaped and curving inward towards the lower light channel 440'.

Positioned on inner top surfaces of the support edges 438 and 438' are elongated LED light engines 435 and 435', having light emitting surfaces facing inward for emitting light into the lower light channel 440', such as described in detail above with reference to FIGS. 3A-C and FIG. 4.

Positioned between walls 442 and 442' of the upper light channel 440 there is an elongated LED light engine 430 positioned on a top surface 427 within the upper light channel 440. For example, elongated LED light engine 430 is centrally positioned on the top surface 427 within the upper light channel 440. The LED light fixture has an asymmetric lens 443 positioned over light emitting surface of the elongated LED light engine 430 to throw light emitted from the elongated LED light engine 430 at an angle out from the open top of the upper light channel 440.

Figure 5A:
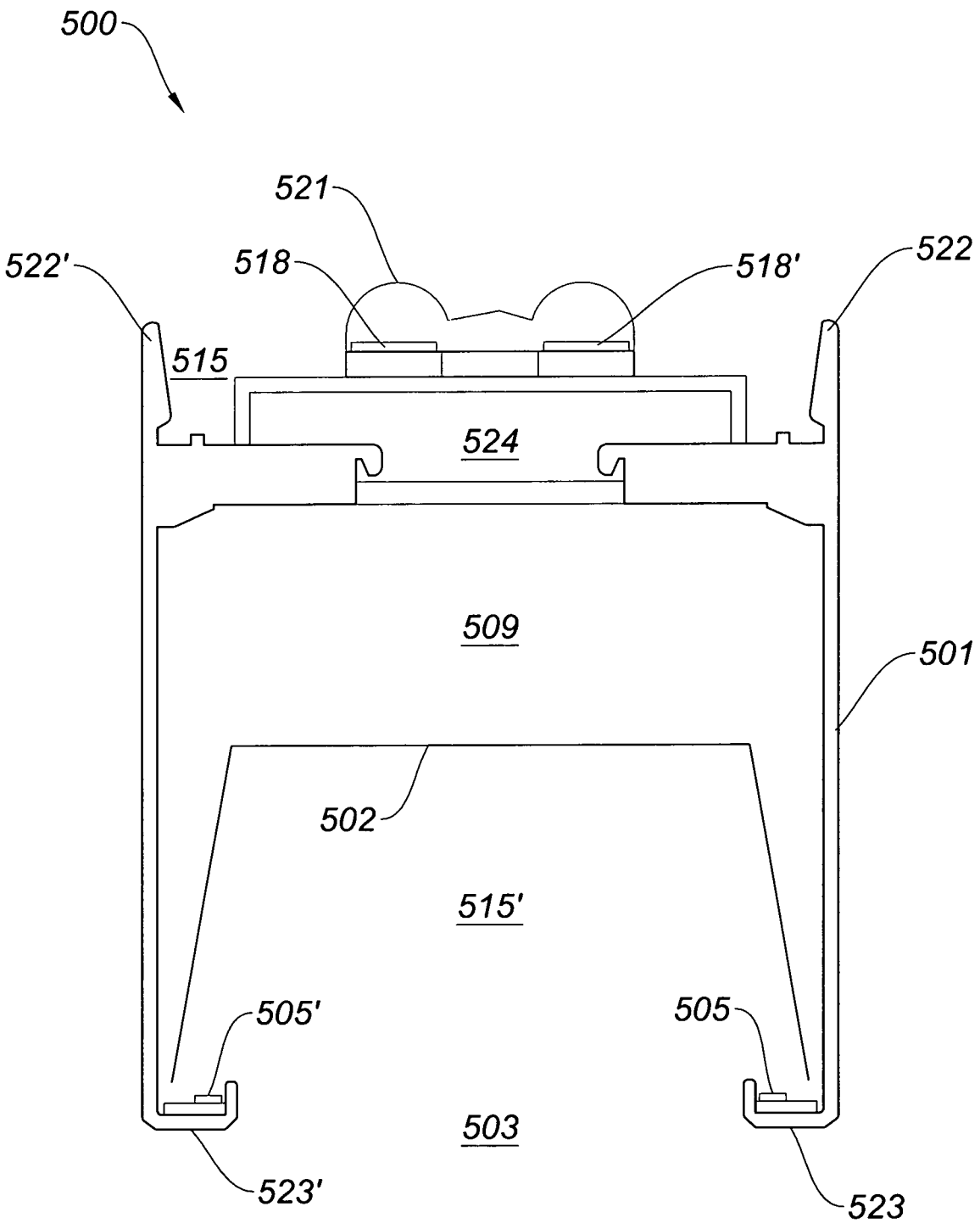
FIGS. 5A-B show cross-sectional views of LED light fixtures with upper light channels and lower light channels, wherein the lower light channels have LED light engines mounted along side walls of the lower light channels having reflective inserts with centrally mounted LED light engines mounted within the upper light channels having a diffusion lens on or over light emitting surfaces of the centrally mounted light engines, in accordance with the embodiments of the invention.

FIG. 5A illustrates cross-sectional view 500 of an LED light fixture with an elongated housing 501 with a truncated H-shaped cross-section that forms an upper light channel 515 with an open top and a lower light channel 515' with an open bottom 503.

Near or at bottom portions of walls of the lower light channel 515' and edges of open bottom 503 of the lower light channel 515' there are elongated support edges 523 and 523' for supporting elongated LED light engines 505 and 505' such as described above. In accordance with this embodiment of the invention, the LED light fixture includes an elongated reflective insert 502 that is formed from metal, plastic, paper or a composite of material. The elongated reflective insert 502 is contoured, angled, curved or any other suitable shape, and preferably extends the length of, or near the length of, the lower light channel 515' within the elongated housing 501. The elongated reflective insert 502 creates a reflection channel within the lower light channel. In operation, light is emitted from elongated LED light engines 505 and 505' into the reflection channel formed by the elongated reflective insert 502 in the lower light channel 515' and the emitted light is reflected off of the reflective insert 502 and emitted out through the open bottom 503 of the lower light channel 515'.

Positioned between angled walls 522 and 522' of the upper light channel 515, there is an elongated LED light engine 524 positioned on a top surface within the upper light channel 515. The elongated LED light engine 524 has sets or arrays of LEDs 518 and 518' that extend along the length of the top surface of the upper light channel 515. The sets or arrays of LEDs 518 and 518' can sets of liner arrays or strips of LED's or can be staggered arrays of LEDs. Positioned over light emitting surfaces of the sets or arrays of LEDs 518 and 518', there is a symmetric diffusion lens 521 for distributing light emitted out from the open top of the upper light channel 515. Between the upper light channel 515 and the reflective insert 502 there is elongated electronics cavity or conduit 509 for housing wiring, LED drivers and/or other control circuitry.

Figure 5B:
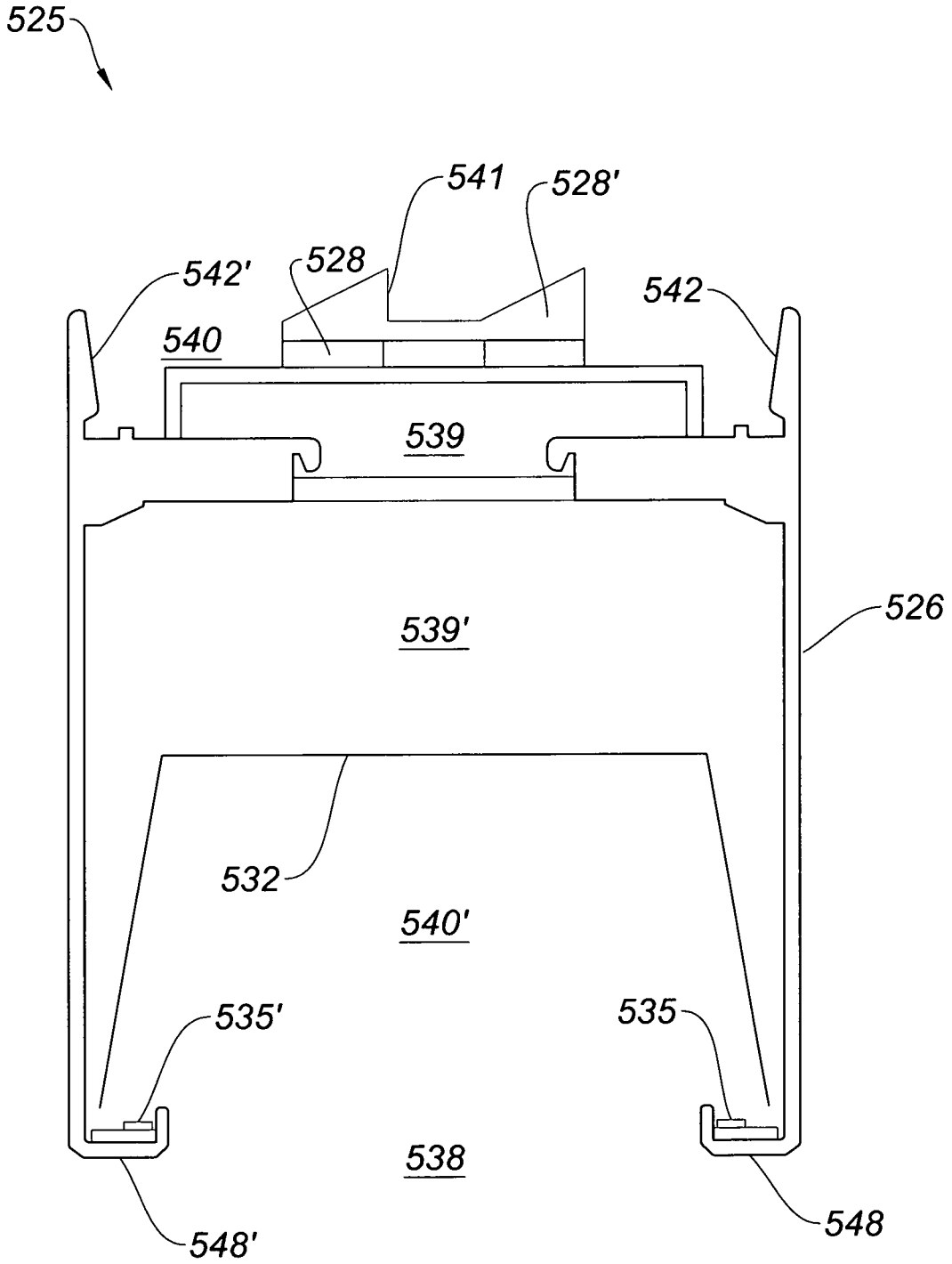

FIG. 5B illustrates cross-sectional view 525 of an LED light fixture with an elongated housing 526 with a truncated H-shaped cross-section that forms an upper light channel 540 with an open top and a lower light channel 540' with an open bottom 538.

Near or at bottom portions of walls of the lower light channel 540' and edges of open bottom 538 of the lower light channel 540' there are elongated support edges 548 and 548' for supporting elongated LED light engines 535 and 535' such as described above. The LED light fixture includes an elongated reflective insert 532 that extends the length of, or near the length of, the lower light channel 540' within the elongated housing 526. Light that is emitted from elongated LED light engines 535 and 535' is reflected off of the reflective insert 502 and emitted out through the open bottom 538, such as described above.

Between angled or bat-wing shaped walls 542 and 542' of the upper light channel 540 there is an elongated LED light engine 539 positioned within the upper light channel 540. The elongated LED light engine 539 has sets or arrays of LEDs 528 and 528', such as described above. In this embodiment of the invention, there is bi-modal asymmetric diffusion lens 541 positioned over light emitting surface of the sets or arrays of LEDs 528 and 528'. Between the upper light channel 540 and the reflective insert 532 there is elongated electronics cavity or conduit 539' such as previously described.

Figure 5C:
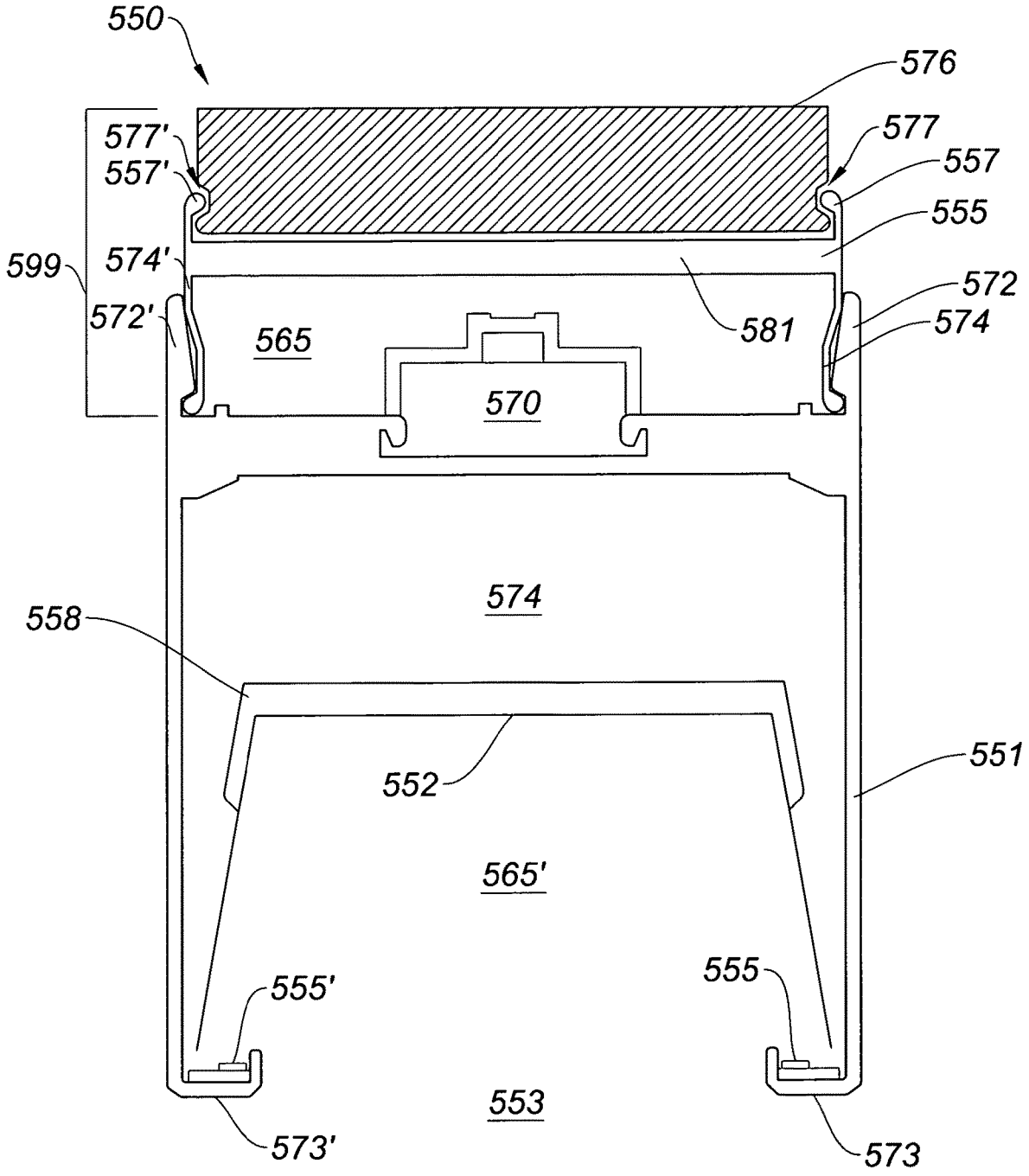
FIG. 5C shows a cross-sectional view of an LED light fixture with an upper light channel and a lower light channel, wherein the lower light channel has LED light engines mounted along side walls of the lower light channel having a reflective insert, with a centrally mounted LED light engine mounted on a top surface and within the upper light channel and having a removable cover structure with a diffusion lens and a detachable baffle structure, in accordance with the embodiments of the invention.

FIG. 5C illustrates cross-sectional view 550 of an LED light fixture with an elongated housing 551 that forms an upper light channel 565 with an open top and a lower light channel 565' with an open bottom 553.

Along bottom edges of open bottom 553, there are support edges or structures 573 and 573', with elongated LED light engines 555 and 555' configured to emit light into the lower light channel 565' and such that the emitted light is reflected off of a reflective insert 552 and out of the open bottom 553. The reflective insert preferably has a structure support 558 for supporting wiring, LED drivers and/or other control circuitry in an elongated electronics cavity or conduit 574 positioned between the upper light channel 565 and the support structure 558 of the reflective insert.

Between walls 572 and 572' of the upper light channel 565 there is an elongated LED light engine 570 positioned within the upper light channel 565. The light fixture 550 further includes a cover structure 599 that is positioned over the upper light cavity 565 and preferably fits into the groove features of the walls 572 and 572' of the upper light channel 565, thereby enclosing the upper light channel 565.

The cover structure 599 includes an elongated H-shaped support feature 581 with a diffusion lens 555 positioned between the first set of snap features 574 and 574', that fit against the groove features of the walls 572 and 572', and a second set of snap features 557 and 557'. The cover structure 599 also includes an elongated baffle structure 576 with fitted groove features 577 and 577', which fit against the second set of snap features 557 and 557' of elongated H-shaped support feature 581, as shown.

Figure 6A:
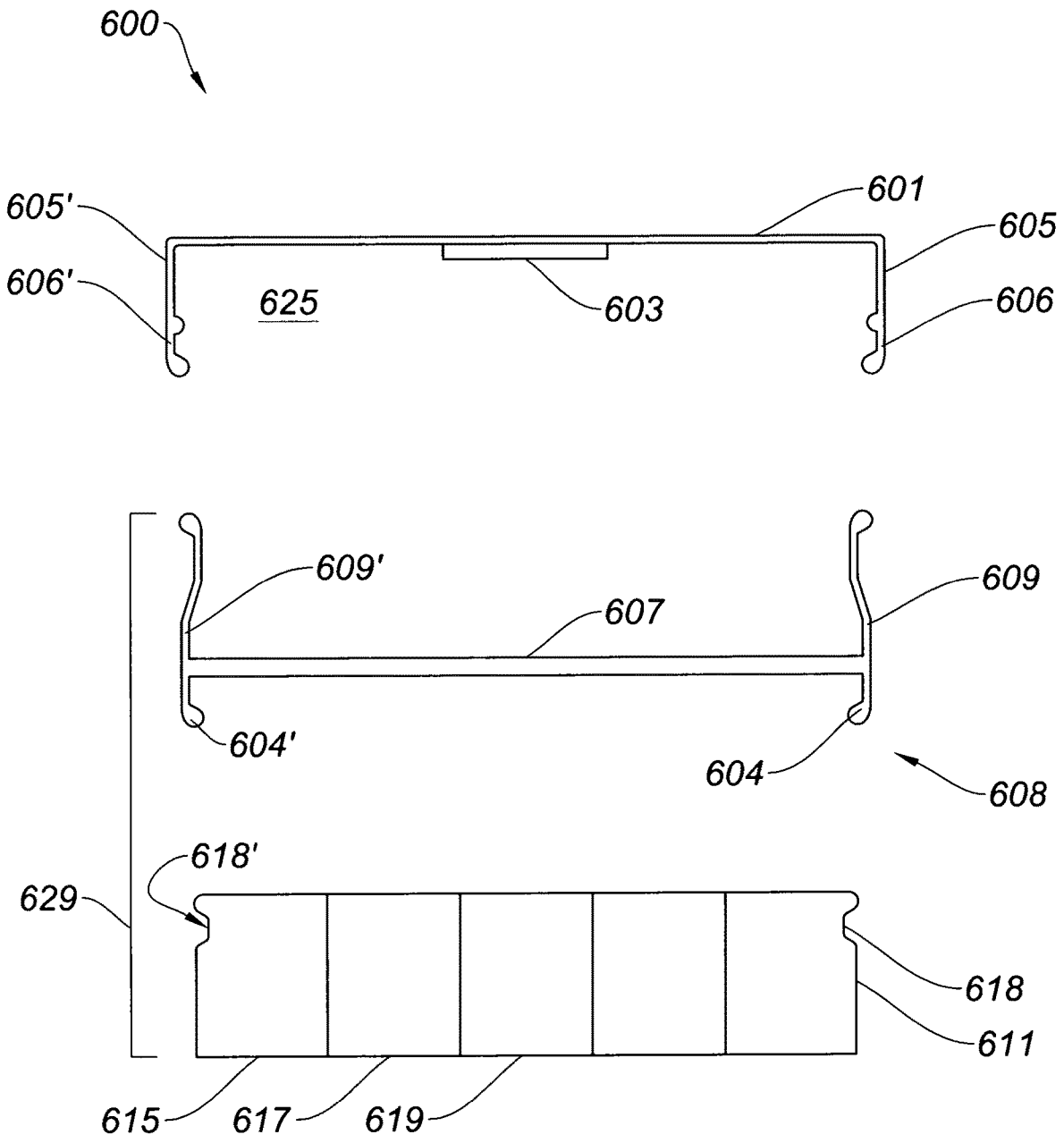
FIGS. 6A-B show a removable cover structure with a diffusion lens and a detachable baffle structure for attaching walls of an elongated light channel of a LED light fixture, in accordance with the embodiments of the invention.
Figure 6B:
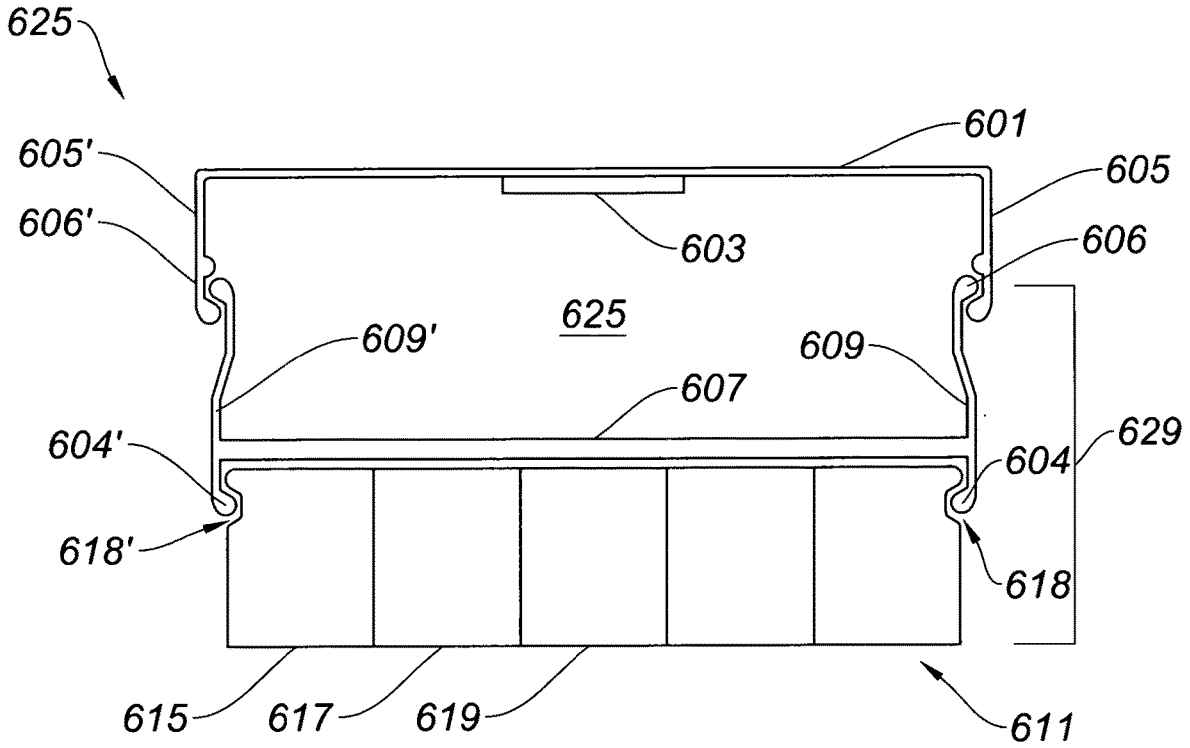

FIGS. 6A-B show schematic representations 600 and 625 of a disassembled and assembled cover structure 629, respectively. The cover structure 629 includes an elongated H-shaped support feature 608 with a diffusion lens 607 positioned between arms of the elongated H-shaped support feature 608. The arms of the arms of the elongated H-shaped support feature 608 include a first set of snap features 609 and 609' and a second set of snap features 604 and 604'. The cover structure 629 also includes a diffusion lens 607 that bridges the arms to form the H-shaped support feature 608 and a baffle structure 611. The baffle structure can be sectionalized into regions 615, 617 and 619 or patterned in any number of ways to create a desired lighting effect.

In operation, the baffle structure 611 is snapped into the H-shaped support feature 608, such that the fitted grooves 618 and 618' snap or fit into second set of snap features 604 and 604'. The cover structure 629 can then be placed over a light channel 615 of an elongated light fixture 601 with a LED light engine 603 positioned therein. To place the cover structure 629 over the light channel 625 of the light fixture 601, the first set of snap features 609 and 609' are fitted or snapped into matched grooved or snap features 606 and 606' on walls 605 and 605' of the light fixture, as shown in FIG. 6B.

Figure 6C:
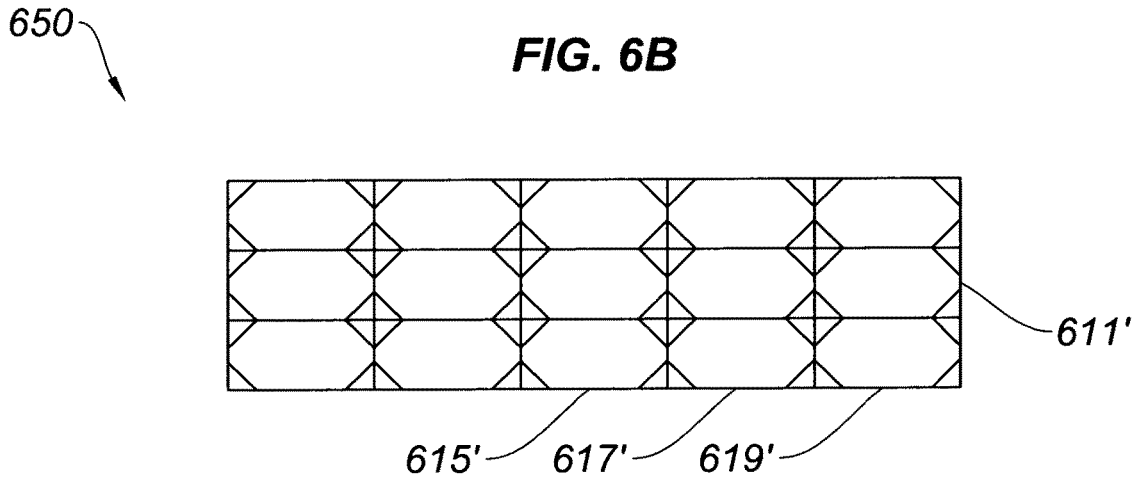
FIG. 6C shows a front surface of the detachable baffle structure illustrated in FIGS. 6A-B.

FIG. 6C illustrates a view 650 of a section of a bottom surface of a baffle structure 611'. As described above, the baffle structure 611 can be sectionalized into regions 615', 617' and 619', or can have any number of patterns or structures to generate a desired lighting effect.

Figure 6D:
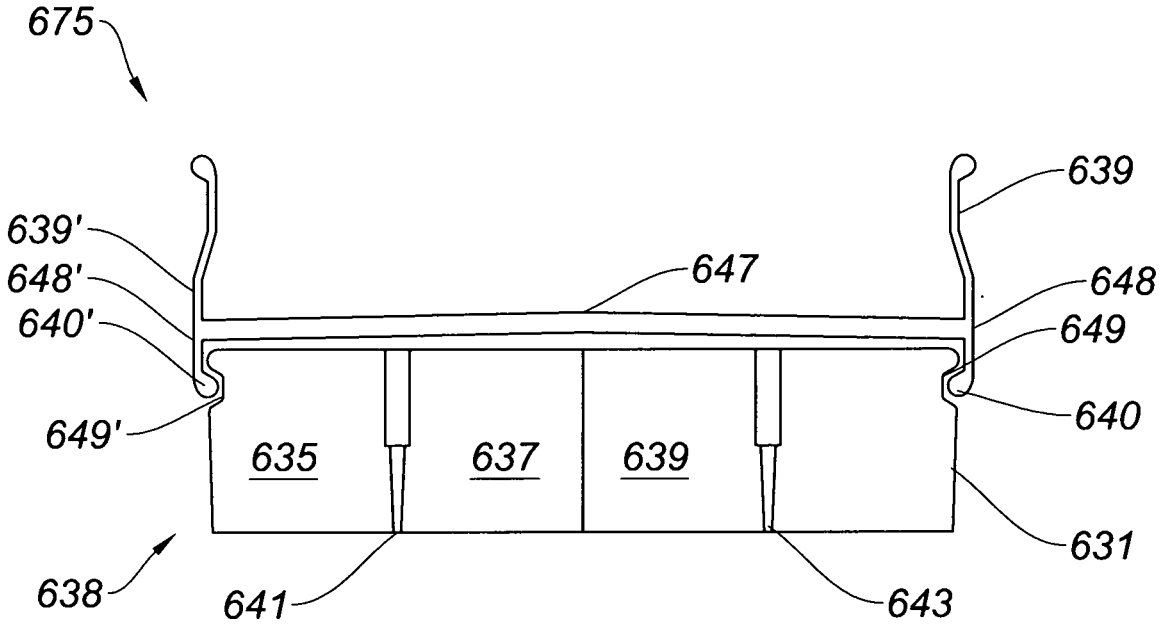
FIGS. 6D-E show removable cover structure with a diffusion lens cover and with a detachable baffle structure with light wave guides for attaching to an elongated light channel of a LED light fixture, in accordance with the embodiments of the invention.
Figure 6E:
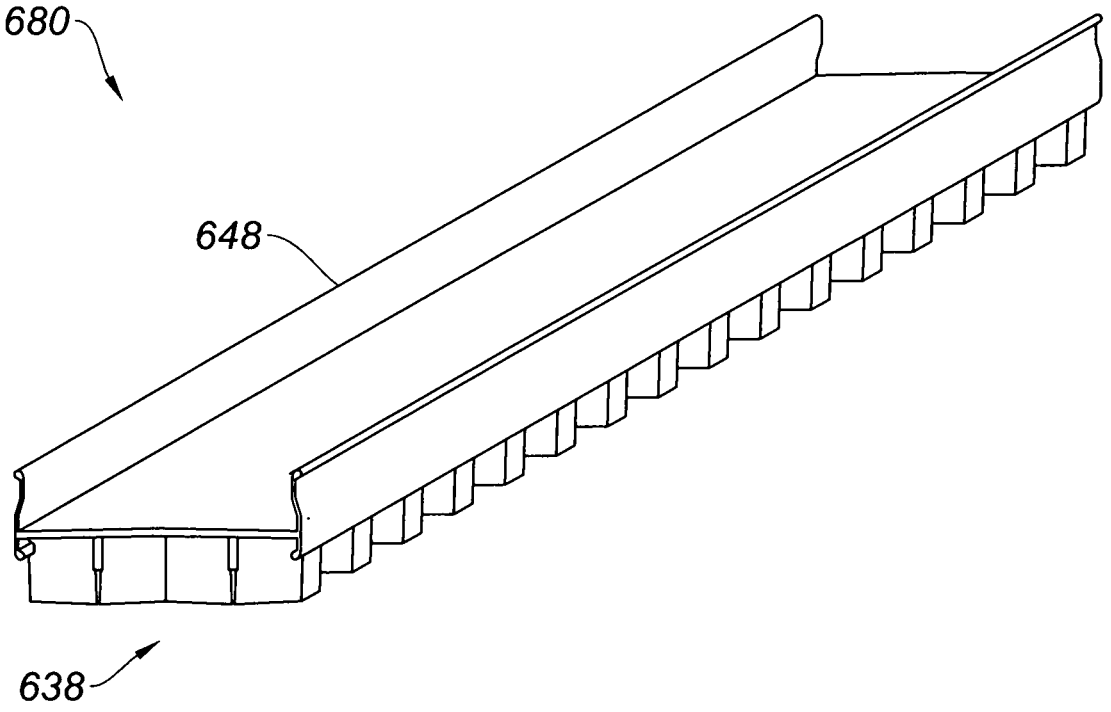

FIGS. 6D-E show a cover structure with a H-shaped support feature with arms 648 and 648' that are bridged by a diffusion lens 647 to form the H-shaped support feature. The arms 648 and 648' have sets of snap features 639/640 and 639'/640' such as described above. The snap features 640 and 640' fit into matched groove features 649 and 649' of a baffle structure 638, such that the baffle structure 638 can be readily replaced or changed out with a different baffle structure. The depicted baffle structure includes a patterned structure 631, which includes regions 635, 637 and 639, that can be separated by light wave guides 641 and 643 that channel light to a bottom surface of the baffle structure 638.

Figure 7:
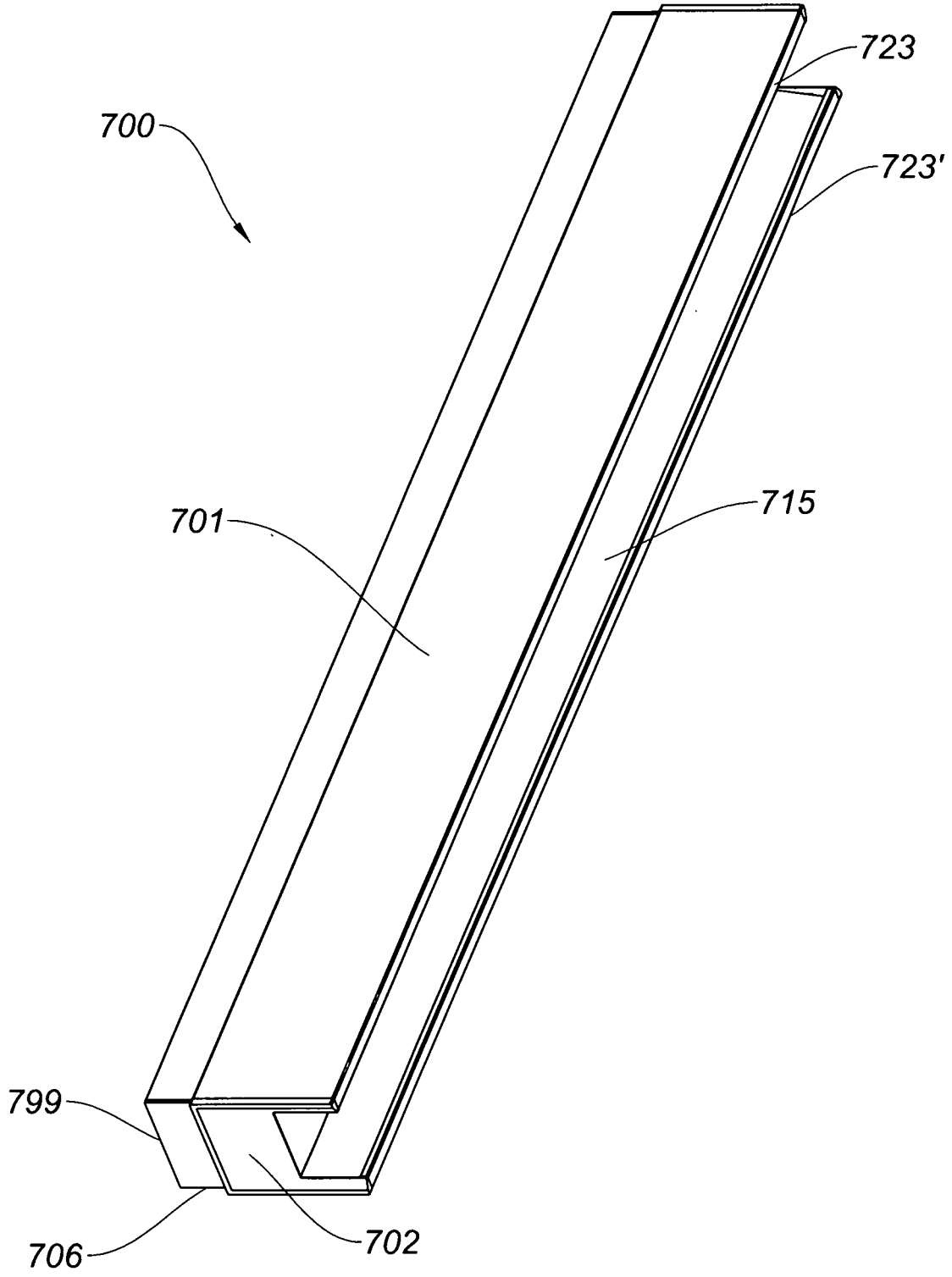
FIG. 7 shows a perspective view of an elongated LED light fixture, similar to the LED light fixture represented in FIG. 5C, with and elongated body having end cap covers and a removable cover structure, in accordance with the embodiments of the invention.

FIG. 7 shows a perspective view of an elongated LED light fixture 700, similar to the LED light fixture represented in FIG. 5C. The elongated LED light fixture 700 includes an elongated housing 701 with end caps 702 that enclose an upper light channel with an elongated LED light engine and an electronics cavity or conduit with electronics, such as previously described in detail with respect to FIGS. 5A-C. The elongated LED light fixture 700 has an open bottom cavity 715 with a reflective insert for providing indirect lighting from internal reflection of light emitted from sets of elongated light engines 723 and 723'. The elongated LED light fixture 700 also preferably includes a cover structure 706 that includes a H-shaped support feature with a diffusion lens and a removable baffle structure. Cover structures preferably snap in place over the upper light channel, such as illustrated with respect to FIG. 5C and FIG. 6B. In operation, cover structures enclose an elongated upper light channel such that light is emitted through the top surface 799 of the cover structure 706.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention. For example, while the LED light fixture of the present invention has been shown herein to be elongated and linear, the LED light fixture can be curved, angled of have other shapes suitable for the application at hand.

What is claimed is:

1. A light fixture comprising:
a) a housing with a lower light channel with an open bottom and upper light channel juxtaposed to the lower light channel;
b) opposed support edges or structures positioned near bottom edges of open bottom;
c) LED light engines positioned on the support edges or structures positioned near the bottom edges of the open bottom, wherein light emitted from the LED light engines into the lower light channel is reflected out through the open bottom; and
d) a detachable cover structure positioned over the upper light channel, wherein the detachable cover structure includes a diffusion lens and a removable baffle structure, wherein includes an H-shaped support feature with sets of snap features that attach to side walls of the upper light channel.

2. The light fixture of claim 1, further comprising a light engine positioned on a top surface and within the upper light channel for emitting light therefrom.

3. The light fixture of claim 1, wherein the light engine that is positioned on the top surface and within the upper light channel includes sets of linear arrays of LEDs.

4. The light fixture of claim 1, further comprising an electronics cavity or conduit positioned between the lower light channel and the upper light channel.

5. The light fixture of claim 1, further comprising a reflective insert that extends through the lower light channel and creates a reflection channel within the lower light channel.

6. A light fixture comprising:
a) a housing that forms an open lower light channel and an upper light channel that is juxtaposed to the open lower light channel;
b) LED light engines positioned on support edges or structures within open lower light channel for emitting indirect and reflected light out from the open lower light channel;
c) a LED light engine positioned within the upper light channel; and
d) a detachable cover structure that includes an H-shaped support feature with arms bridged by a diffusion lens and a baffle structure.

7. The light fixture of claim 6, further comprising an electronics cavity or conduit positioned between the open lower light channel and the upper light channel.

8. The light fixture of claim 6, wherein arms of the H-shaped support attach to side walls of the upper light channel and to matched groove features on the baffle structure.

9. The light fixture of claim 6, further comprising an elongated reflective insert that extends through the open lower light channel and creates a reflection channel from which the indirect and reflected light is emitted.

10. A light fixture comprising:
a) an elongated housing that forms a open lower light channel and an upper light channel that is juxtaposed to the open lower light channel;
b) elongated LED light engines positioned on support edges or structures within open lower light channel for emitting indirect and reflected light out from the open lower light channel;
c) an elongated LED light engine positioned within the upper light channel;
d) an elongated reflective insert that extends through the open lower light channel and creates a reflection channel from which the indirect and reflected light is emitted; and
e) detachable cover structure that fits over the upper light channel, wherein the detachable cover structure includes a H-shaped support feature with arms and a baffle structure, wherein the arms have sets of snap features that attach to side walls of the upper light channel.

11. The light fixture of claim 10, wherein the housing forms an electronics cavity or conduit positioned between the open lower light channel and an upper light channel.

* * * * *